US005348305A

United States Patent [19]

Lowe

[11] Patent Number: 5,348,305

[45] Date of Patent: Sep. 20, 1994

[54] GOLF BALL TEEING APPARATUS

[76] Inventor: Richard D. Lowe, 3 West St., Windsor Locks, Conn. 06096

[21] Appl. No.: 991,728

[22] Filed: Dec. 17, 1992

[51] Int. Cl.[5] ..... A63B 57/00

[52] U.S. Cl. ..... 273/201

[58] Field of Search ..... 273/201

[56] References Cited

U.S. PATENT DOCUMENTS

| | | | |
|---|---|---|---|
| 2,013,881 | 9/1935 | Fleming | 273/201 |
| 2,127,282 | 8/1938 | Beckett | 273/201 |
| 2,696,985 | 12/1954 | Hogeberg | 273/201 |
| 4,017,087 | 4/1977 | Bruno . | |
| 4,126,313 | 11/1978 | Izumi . | |
| 4,132,214 | 1/1979 | Schnurr et al. . | |
| 4,140,232 | 3/1979 | Stone . | |
| 4,198,054 | 4/1980 | Stone . | |
| 4,355,811 | 10/1982 | Williams, Sr. . | |
| 4,602,789 | 7/1986 | Chung | 273/201 |
| 4,659,081 | 4/1987 | Cook . | |
| 4,662,641 | 5/1987 | Peyret, Jr. . | |
| 4,676,397 | 6/1987 | Hoffmeister . | |
| 4,741,537 | 5/1988 | Adam . | |
| 4,815,744 | 3/1989 | Diamandis . | |
| 4,832,345 | 5/1989 | Monasco . | |
| 4,981,299 | 1/1991 | Petrillo . | |
| 5,018,731 | 5/1991 | Doyle . | |
| 5,022,657 | 6/1991 | Bussiere et al. | 273/201 |
| 5,052,688 | 10/1991 | Shiau . | |
| 5,052,689 | 10/1991 | Lettrich . | |
| 5,078,401 | 1/1992 | Fehrenbach et al. . | |

*Primary Examiner*—Vincent Millin
*Assistant Examiner*—Steven B. Wong
*Attorney, Agent, or Firm*—Fishman, Dionne & Cantor

[57] ABSTRACT

A golf ball teeing apparatus for continuous teeing of a supply of golf balls for driving or the like is presented. The golf ball teeing apparatus includes a platform, a housing having two chambers, a reciprocable pair of camming plates with angular upper camming surfaces, a piston with a tee mounted thereon and an actuator. Each of the reciprocable camming plates are adapted for sliding through one of the two chambers. The housing also includes an input which communicates with a first of the two chambers wherein a first of the two reciprocable camming plates is located. Located within a second chamber is the piston which is adapted for slideably engaging the upper camming surface of a second camming plate. After entering the housing through the input and upon actuation of the first and second reciprocable camming plates, a golf ball is slid upwardly along the upper camming surface of the first camming plate within the first chamber of the housing as the piston and tee slides downwardly along the upper camming surface of the second camming plate within the second chamber of the housing. Once the golf ball reaches the apex of the upper surface of the first camming plate, it rolls downwardly onto the tee. The piston and tee are then moved back upwardly by a return of the reciprocable plates and is ready to be struck by a golfer.

27 Claims, 10 Drawing Sheets

(SYSTEM AT REST)

(MANUAL SEQUENCE START)

(AUTOMATIC SEQUENCE)

(ASSEMBLY 228 SHOWN WITH NO BALL ON TEE)

GOLF BALL TEEING APPARATUS

BACKGROUND OF THE INVENTION

This invention relates to devices for use in practicing the sport of golf and, more particularly, to devices for teeing golf balls.

Numerous devices have been proposed for teeing golf balls, for example U.S. Pat. No. 4,198,054 to Stone discloses a tee mounted in a vertical chamber on a piston, which is attached by a connecting rod to a cam. The tee is moved in a rectilinear fashion upon actuation of the cam by a motor. Problems that arise in the use of this device are, among others, a very complicated structure including a motor mounted below the tee leading to high manufacturing and maintenance costs, no tee height adjustability by the golfer, and no easy and inexpensive replacement of tee if damaged. U.S. Pat. No. 4,741,537 describes a structure including a surface having a sculpted portion for receiving a golf ball. The sculpted portion includes an aperture and disposed directly below the aperture is a tee having a central bore. The tee is mounted on top of a floating piston which is disposed within a chamber. The chamber is continuously pressurized from below the piston and the fluid escapes through the aperture and bore. When a ball is loaded onto the sculpted portion from an above ground track, the ball cuts off the flow of air through the tee, causing the piston and tee to rise. Problems with this structure include no adjustment for tee height, exposing to the elements the above ground track for golf balls and no easy replacement of the tee. U.S. Pat. No. 5,078,401 to Fehrenbach et al. discloses a tee which is driven by a vertical screw shaft powered by an electric motor. This device is also relatively complex and expensive to manufacture and maintain. Additionally, the tee is not easily replaced. U.S. Pat. No. 4,659,081 to Cook, employs a pneumatic teeing system with foot-operated bellows. Problems with the use of this device include a very complicated dual bellows system requiring as with the above devices, a high manufacturing and maintenance cost. In addition, there is the requirement of foot actuation of the bellows which may cause the operator to lose his stance thereby defeating a main purpose for automating the teeing of golf balls.

Various other devices for teeing golf balls have been disclosed in the following U.S. Pat. Nos. 4,602,789, 4,676,397, 4,146,232, 4,132,214, 4,832,345, 4,815,744, 4,017,087, 5,052,688, 4,981,299, 4,662,641 and 4,355,811. This list is not intended in any way to be an exhaustive list of the prior art.

SUMMARY OF THE INVENTION

The above-discussed and other drawbacks and deficiencies of the prior art are overcome or alleviated by the golf ball teeing apparatus of the present invention. In accordance with the teeing apparatus of the present invention, a pair of reciprocable camming plates are provided for camming a golf ball and a piston, having a tee mounted thereon, upwardly and downwardly within a housing. The camming plates include camming surfaces which are angled approximately the same although they are mounted in opposed directions so that when the golf ball is moved upwardly the tee moves downwardly within the housing. A first of the two camming plates is tilted toward a second whereby when the golf ball is raised to a certain height it will fall downwardly onto the tee. The housing also includes an input means whereby a golf ball may enter a first of two chambers for engaging the first camming surface. The two chambers are defined by a guide means which directs the golf ball and the piston within the housing. An actuation means is provided for reciprocating the camming plates and an adjustment means is also provided for setting the height of the tee. The actuation means is activated by a golfer who taps a button with a golf club when a teeing of a golf ball is desired.

In a first alternate embodiment, a second piston is provided for engaging the first camming plate within the first chamber.

In a second alternate embodiment, a means for automatically replacing the golf ball when it has been driven from the tee is provided.

A first feature of the present invention is the ease of manufacturing of the camming plates and housing of the present invention.

Another feature is the low manufacturing cost of the present invention.

Still another feature is the minimal exposure to the elements provided in the structure of the present invention.

Still yet another feature is the herein disclosed structure which provides for easy replacement of the tee.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DESCRIPTION OF THE PREFERRED EMBODIMENT

Figure 1:
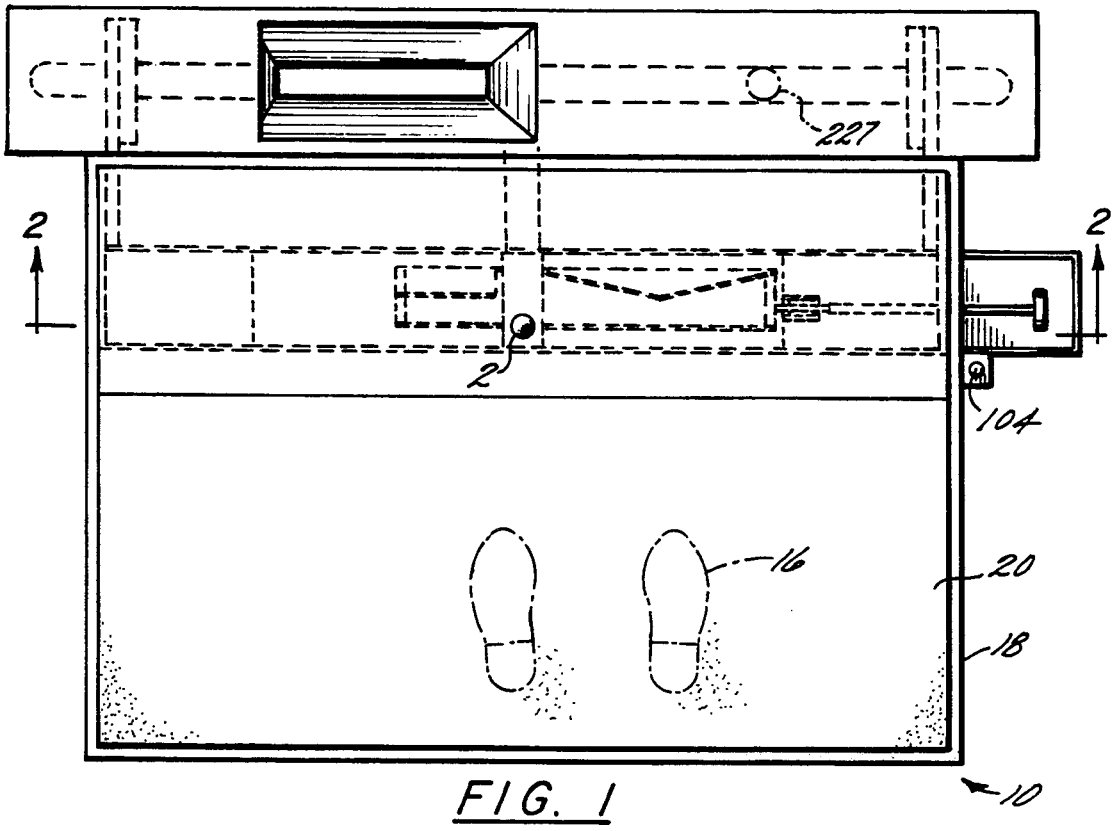
FIG. 1 is a top plan view of a golf ball teeing apparatus according to the present invention.
Figure 2:
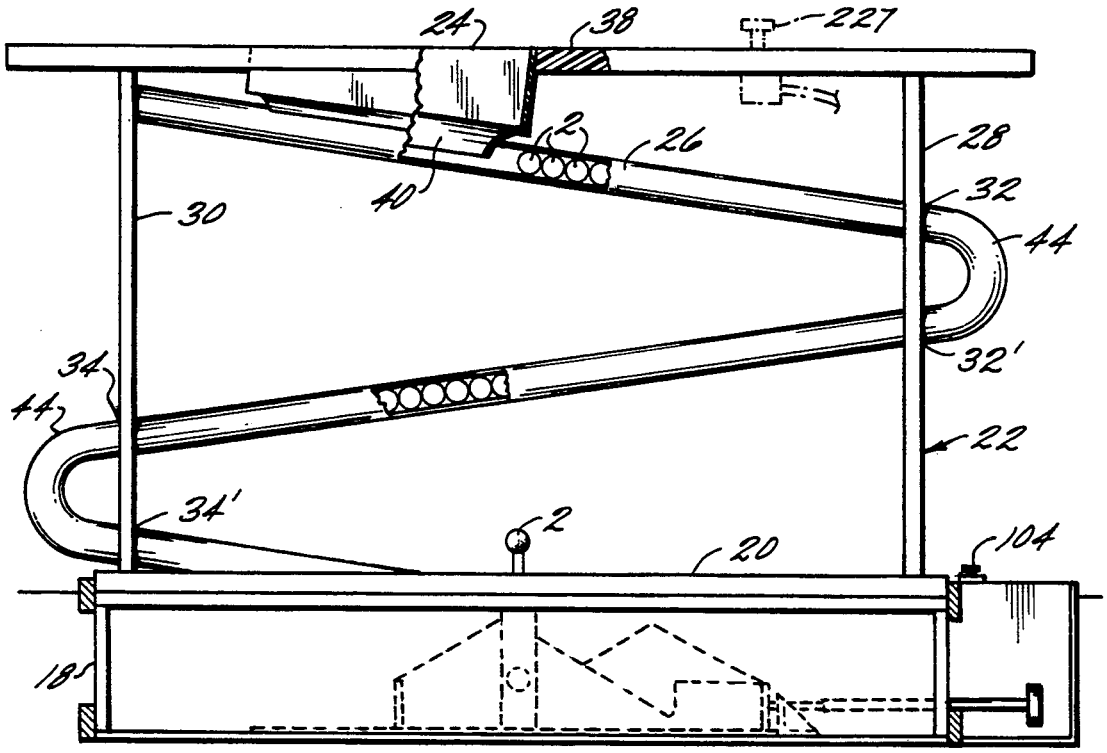
FIG. 2 is a sectional view along line 2—2 of FIG. 1 with the tub and conduit of the golf ball holding device partially cut away.

Referring generally to FIGS. 1 and 2, the golf ball teeing apparatus of the present invention is shown generally at 10. The teeing apparatus includes a platform 12 which is interconnected with a ball holding and delivery device 14. Platform 12 is provided by way of illustration, however, it will be understood that any suitable means for housing the golf ball teeing device and supporting a golfer (illustrated as standing at position 16) may be utilized such as, for example, a concrete pad with a compartment for the golf ball teeing apparatus. The platform 12 may be formed of wood and includes a frame 18 and a flooring 20 which may be fastened together by any suitable means, e.g. screws. The ball holding device 14 is illustrated as including a supporting structure 22, which may also be formed of wood, a tub 24 and a conduit 26, although, it will be understood that any suitable means for holding the balls may be provided. The supporting structure 22 has a pair of vertical posts 28 and 30 which include apertures 32 and 32' and 34 and 34'. A horizontal beam 36 is disposed between the vertical posts 28 and 30 and is locked in engagement therewith by such suitable means as screws (not shown). The lower ends of vertical posts 28 and 30 may also be fastened to the frame 20 for support (not shown). Beam 36 includes an aperture 38 wherethrough the tub 24 is disposed for receiving a plurality of golf balls 2 therein. The tub 24 may be formed of any suitable material such as, for example, a polyolefin and has a lower hollow tubular portion 40 which extends through a slot 42 into the conduit 26. Tub 24 may also include a cover (not shown) for preventing a foreign substance such as moisture and the like from entering the tub or the conduit 26. The latter communicates with the tub 24 through tubular portion 40 so that golf balls 2 may be funnelled therethrough for introduction into the conduit 26. A longitudinal axis of the tub 24 is parallel with a central axis of the conduit 26 which is angled downwardly at an acute angle relative to a longitudinal axis of the horizontal beam 36. Conduit 26 may also be formed of a polyolefin and extends through apertures 32, 32', 34 and 34' and includes curved portions 44 for effecting a "zig zag" type of shape which are at an angle which is less than 180 degrees. The conduit 26, at the opposite end from the tub 24, communicates with the teeing apparatus 10 through a lower section 46.

Figure 3:
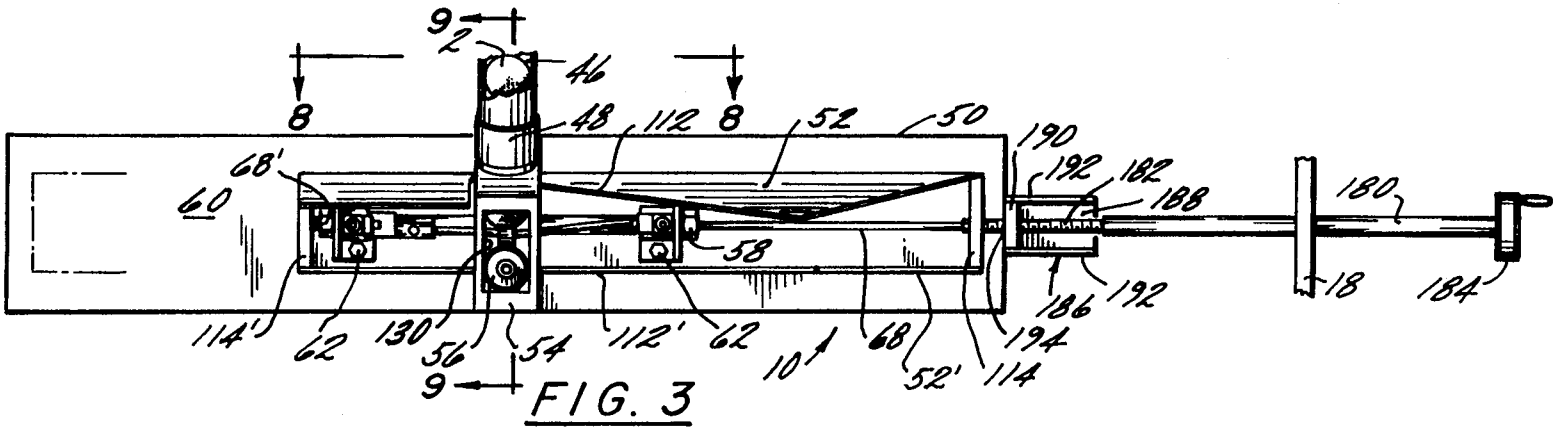
FIG. 3 is a top plan view of the golf ball teeing apparatus of FIG. 1.
Figure 5:
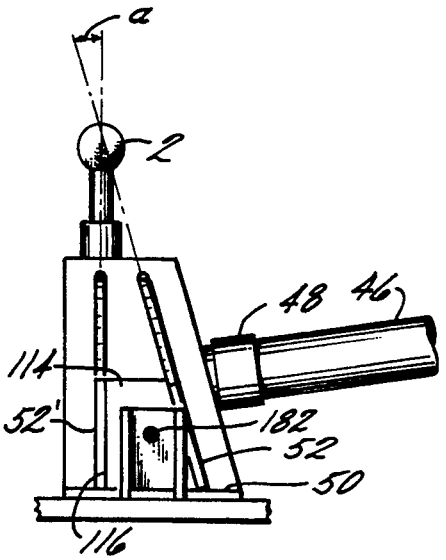
FIG. 5 is a sectional view taken along the line 5—5 of FIG. 4.
Figure 6A:
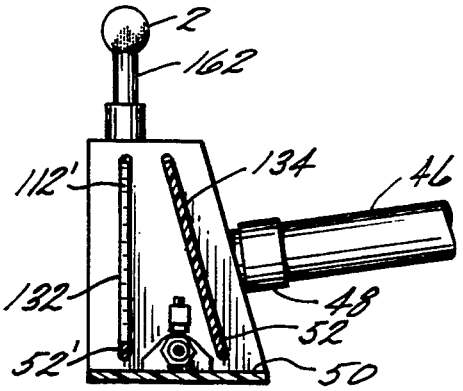
FIG. 6A is a sectional view taken along the line 6A—6A of FIG. 4.
Figure 6B:
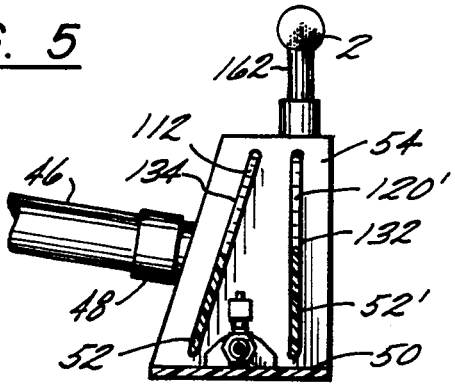
FIG. 6B is a sectional view taken along the line 6B—6B of FIG. 4.
Figure 17:
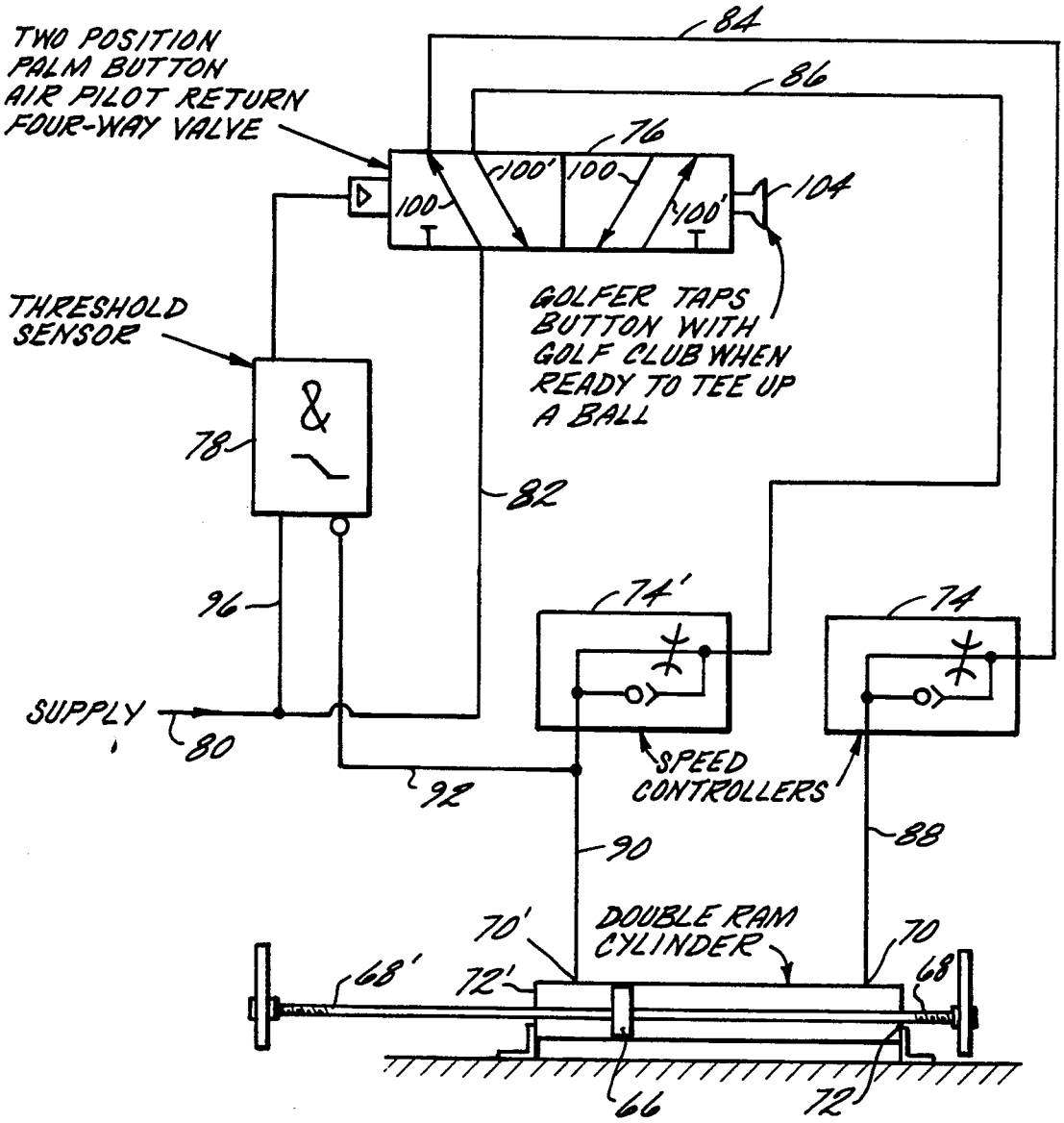
FIG. 17 is a schematic design showing the actuation means of the present invention.

Referring now generally to FIGS. 3, 5 and 17, the lower section 46 of conduit 26 mates with a sleeve 48 of the teeing apparatus 10. The inventor hereof has found that lower section 46 and sleeve 48 must be at least a minimum of five (5) degrees with a preference of 8 degrees with respect to a horizontal plane parallel with the ground to ensure that the golf balls 2 travel through the lower section 46. An incline of not much greater than 8 degrees is also advantageous since if the lower section 46 is disposed at too steep an angle, too much force will be placed on the balls 2 entering the teeing apparatus 10 and binding problems in the teeing apparatus 10 may occur.

The golf ball teeing apparatus 10 also includes a base 50, a reciprocable pair of camming plates 52 and 52', a housing 54, a piston 56 and an actuation means 58. It will be appreciated that while base 50 is provided in this embodiment of the present invention any means or even no base is necessary to practice this invention. The base 50 may be formed of any suitable material and includes a smooth upper surface 60 whereon the camming plates 52 slide which will be more fully described hereinafter. The base 50 may also be generally rectangular in shape and generally thin in cross-section.

It will be understood that the actuation means 58 may be any suitable means by which camming plates 52 and 52' may be reciprocated. The present embodiment includes a pneumatic actuation system which is advantageous in its small size and ability to generate substantial force. The actuation means 58 is mounted to the base 50 by appropriate brackets and fasteners, for example, bolts 62 and includes a double ram cylinder 64, an actuator piston 66 and arms 68 and 68'. While a double ram cylinder 64 has been described it will be appreciated that the actuation means 58 may comprise a single ram cylinder as is readily understood by one of ordinary skill in the art. The cylinder 64 includes ports 70 and 70' located near ends 72 and 72' of the cylinder for the passage of a fluid into and out of cylinder 64. When, for example, end 72 of actuator piston 66 is pressurized and side 72' is depressurized actuator piston 66 will move laterally toward end 72. Speed controllers 74 and 74', may be for example part number PWR-E14487 manufactured and sold by Telemecanique Inc. which provides for varying the rate at which the piston 66 is moved from end 72 to end 72' or vice versa. To effectuate this variation in rate, speed controllers 74 and 74' function to restrict the exhaust rate, thereby decreasing the rate at which the piston 66 may move.

Figure 8:
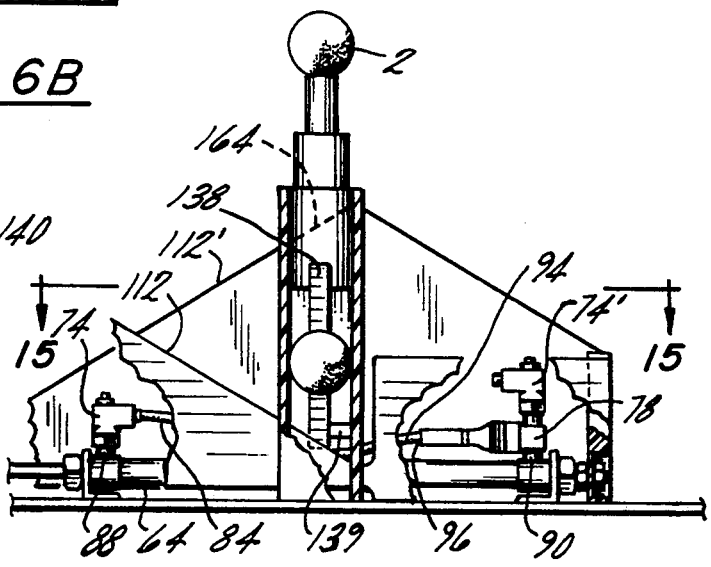
FIG. 8 is a sectional view taken along the line 8—8 of FIG. 3 partially cut away showing the internal of a housing, an actuation means of the present invention and a tee and ball in the full up position for driving.

As illustrated in FIGS. 8 and 17, the actuation means 58 further includes a two position valve 76, a threshold sensor 78 and a supply 80. The supply 80 is connected via a conduit 82 to the two position valve 76 and conduits 84 and 86 provide communication between the valve 76 and the speed controls 74 and 74'. Conduits 88 and 90 provide communication between the cylinder 64 and the speed controllers 74 and 74'. The threshold sensor 78 is connected by conduit 92 to conduit 90, by conduit 94 to the pilot of valve 76 and by conduit 96 to the supply 80. The two position valve 76 includes internal ports which are illustrated by arrows 100 and 100' and are provided for connecting the supply 80 via conduit 82 to either conduit 84 or 86 depending upon the state of the valve actuation. The valve 76 may be, for example, a two position palm button air pilot return four-way valve part number 5040-21 manufactured and sold by Aro Fluid Products. Arrows 100 and 100' represent internal ports which communicate within the valve for diverting pressure and releasing exhaust to and from cylinder 64. Button 104 is provided for manual actuation of the valve 76 which may be actuated by a golfer's golf club and is disposed in generally planar position with the platform 12 (FIG. 1).

The threshold sensor 78 may be, for example, part number PWS-C3148 manufactured and sold by Telemecanique, Inc. which receives fluid pressure via conduit 96 and is provided for ensuring a reciprocation cycle after the cylinder 64 reaches its maximum back stroke. The sensor 78 monitors the residual pressure drop when piston 66 stops moving, at which point the sensor 78 sends a pressure pulse of fluid via conduit 94 to the pilot of valve 76, shifting the valve and reversing movement of the piston 66.

Also referring to FIGS. 3–8, arms 68 and 68' extend outwardly of the cylinder 64 and at each distal end thereof and are mounted to the end plates 114 and 114' by suitable fasteners. The camming plates 52 and 52' may be formed of any suitable material but are preferably a plastic such as polyolefins, polycarbonates and the like and are generally thin in cross-section. The two camming plates 52 and 52' are overall about the same shape which lends itself easily to manufacturing (through such means as injection molding or the like) and assembly, and are mounted spaced apart and in an inverse manner with each other. The camming plates 52 and 52' include recesses 110 and 110' (FIG. 10) and upper camming surfaces 112 and 112' and terminate at end plates 114 and 114'. End plates 114 and 114' are disposed between camming plates 52 and 52' and are fastened therebetween by any suitable means such as an adhesive or may even be molded therewith. Camming plate 52' is disposed perpendicular to the base 50 and adjacent surface 116 of the end plate 114. Camming plate 52 is disposed at an acute angle "a" with respect to camming plate 52' and outer surfaces 116 and 118' of end plates 114 and 114' are shaped to accommodate this. Angle "a" may be, for example, approximately 16 degrees, and is provided for use in teeing the golf balls 2 which will be more fully described hereinafter. Recesses 110 and 110' are disposed on the lower edges of camming plates 52 and 52' and are provided for engaging the housing 54 which will be more fully described below.

Camming surfaces 112 and 112' are each inclined at a suitable angle "b" for raising and lowering the golf ball 2 and the piston 56 within the housing 54. Angle "b" may be any suitable angle although it is preferably approximately 30.5 degrees. Each camming surface 112 and 112' is located on an upper central portion of the camming plates 52 and 52' between a trailing surface 120 and 120' and a level surface 122 and 122' respectively. The trailing surfaces 120 and 120' each terminate at an end which is approximately the same height as the level surfaces 122 and 122' for engagement with the end plates 114 and 114'.

The housing 54 may be formed of any suitable material although same is preferably a plastic, such as polyolefins, polycarbonates and the like, and includes a central aperture 130, a pair of slots 132 and 134 (FIGS. 6A–B), an input tube 136 and a central guide piece 138. The input tube 136, at one end, engages sleeve 46 and, at the other end, is disposed through an input aperture 140 of the housing 54. A lower edge 142 of the input tube 136 extends into the central aperture 130 for preventing the golf balls 2 from dropping on to the lowest portion of surface 112' and then other golf balls 2 falling on top and then binding up the teeing device 10. The central guide piece 138 is disposed within the central aperture 130 of the housing 54 and may be formed of the same material as the housing. The guide piece is mounted within the central aperture (bore) 130 and defines two chambers 147 and 149 and the former may also be the same material as the housing 54. Chamber 147 is sized for receiving the golf ball 2 and chamber 149 is sized to receive the piston 56. Fasteners 139 are provided for affixing the guide piece 138 to the housing 54. The guide piece 138 includes a surface 144 which is shaped to be generally parallel to the transverse axis of the camming plate 52 and a second surface 146 of guide piece 138 is structured to be generally parallel to the transverse axis of camming plate 52'. Each side of housing 54 includes elongated slots 132 and 134 which are angled to properly receive the camming plates 52 and 52' respectively therethrough. The slots 132 and 134 terminate before the lower and upper edges of the housing 54. Reliefs 110 and 110' of the camming plates 52 and 52' slideably engage the lower edges of the slots 132 and 134.

Piston 56 may be generally circular in cross-section and may be formed from any suitable material and comprises a lower slot 160, an upper threaded portion 161 and a hollow rubber tee 162. The lower slot 160 extends through the piston 56 and is shaped to receive the camming surface 112' therein. To properly slide along camming surface 112', an engaging surface 164 is provided which is angled to match the former. The tee 162 has a receptacle 168 which mates with the threaded portion 161 to thereby provide a structure whereby the rubber tee 162, which quickly becomes worn from use by golfers, may be easily replaced. It also insures that the rubber tee 162 is held securely in an upright position, as well as providing an air-tight seal between piston 56 and receptacle 168 when used with the second alternate embodiment described hereinafter.

A pair of rectangular slots 170 and 170' are provided in the lower portion of the housing 54 for passing the cylinder 64 therethrough.

Figure 4:
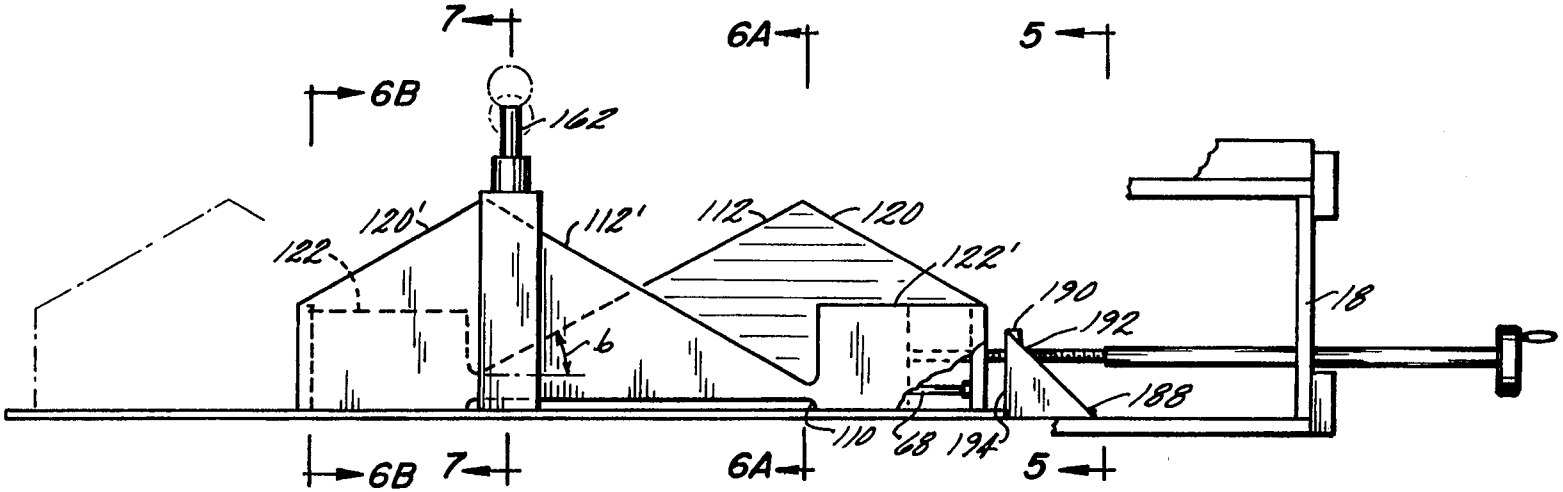
FIG. 4 is a front elevational view of the device of FIG. 3.

As depicted in FIGS. 3 and 4 an adjustment means is provided for varying the height of the tee which includes a rod 180 having a threaded portion 182 and a finger wheel portion 184 and a mount 186. The adjustment means functions to vary the distance which the camming plates 52 and 52' may travel during a reciprocation cycle which will be described below. By extending this distance, and because of the camming surface 112', the tee is disposed higher and conversely by shortening this distance the tee is disposed lower.

The mount 186 includes a base portion 188 and extending therefrom is an upright portion 190 affixed in position by side portions 192. Upright portion 190 includes a threaded bore 194 wherethrough the threaded portion 182 of the rod 180 extends. Rod 180 extends through a tubular hole (not shown) in the frame 18.

Figure 7:
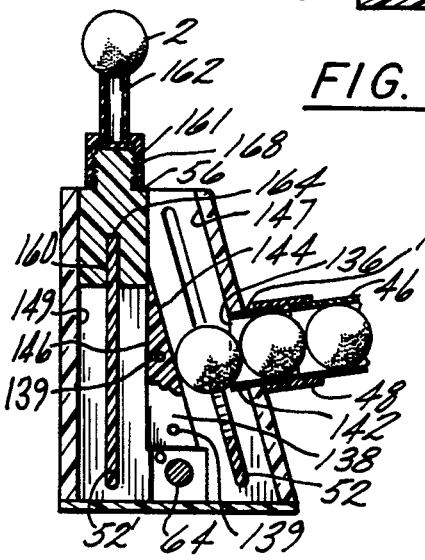
FIG. 7 is a sectional view taken along the line 7—7 of FIG. 4.
Figure 9:
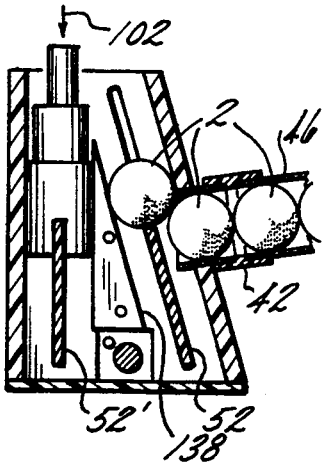
FIG. 9 is a sectional view taken along the line 9—9 of FIG. 3 and a sequential view of FIG. 8 with the tee sliding downwardly and a second ball ready to be lifted upwardly.
Figure 10:
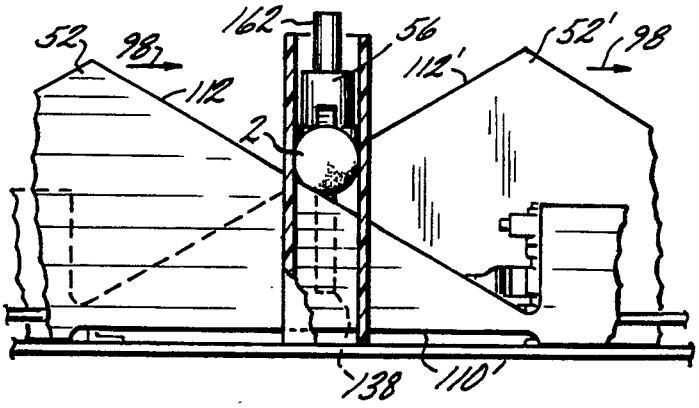
FIG. 10 is a sequential view of FIG. 8 corresponding with the view of FIG. 9.
Figure 11:
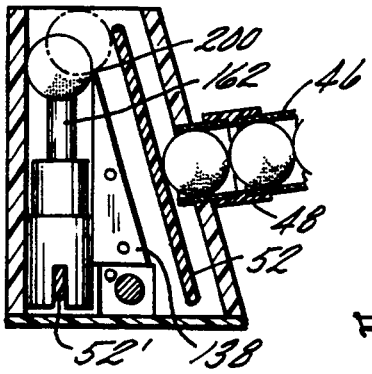
FIG. 11 is a sequential view of FIG. 9 showing the second ball dropping onto the tee.
Figure 12:
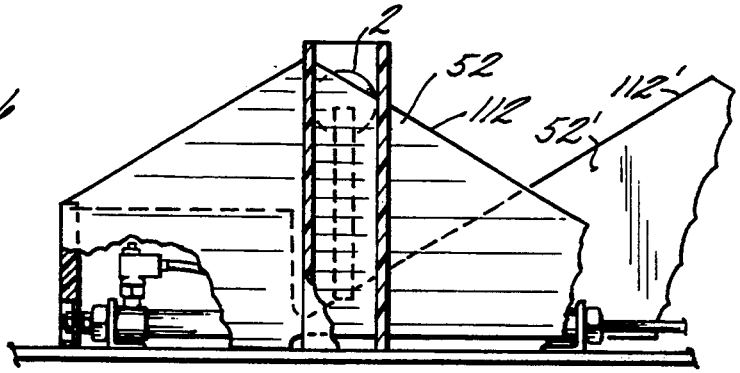
FIG. 12 is a sequential view of FIG. 10 corresponding to that of FIG. 11.

The operation of the teeing device 10 is shown in sequential FIGS. 7, 9 and 11 and which correspond to FIGS. 8, 10 and 12. Camming plates 52 and 52' are moved in a rectilinear fashion by the actuation means 58. A reciprocation cycle begins with the tee 162 and first golf ball 2 in the upper position (FIGS. 7 and 8) and a second golf ball captivated between the lower edge 142 of input tube 136 and the central guide piece 138. After the golfer has driven the first golf ball off the tee 162 the golfer taps button 104 which shifts the two position valve causing piston 66 and arms 68 and 68' to move, as previously described, and in turn causing the camming plates 52 and 52' to move in the direction of arrows 98 (FIG. 10) and the piston 56 and tee 162 to slide down camming surface 112' as illustrated by arrow 102 (FIG. 9) while the second golf ball 2 is slid upwardly along camming surface 112 and tending, because of angle "a" (FIG. 5) of camming plate 52 toward camming plate 52', to ride against surface 144 of the central guide 138. Upon the second golf ball 2 passing an upper tip 200 of the central guide 138 (FIGS. 11 and 12), the second golf ball will fall onto the tee 162. Next, at the proper time as previously described, the threshold sensor will return the two position valve to the initial position thereby causing the piston 66 to return in the direction of the initial position and in turn returning camming plates 52 and 52' and thereby raising the tee 162 to the uppermost position (FIGS. 7 and 8).

Figure 13:
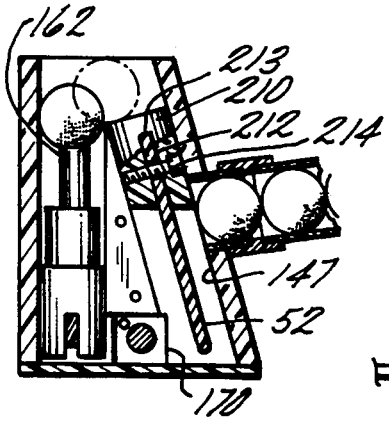
FIG. 13 is the sectional view of FIG. 9 including an alternate embodiment of the ball lifting means.
Figure 14:
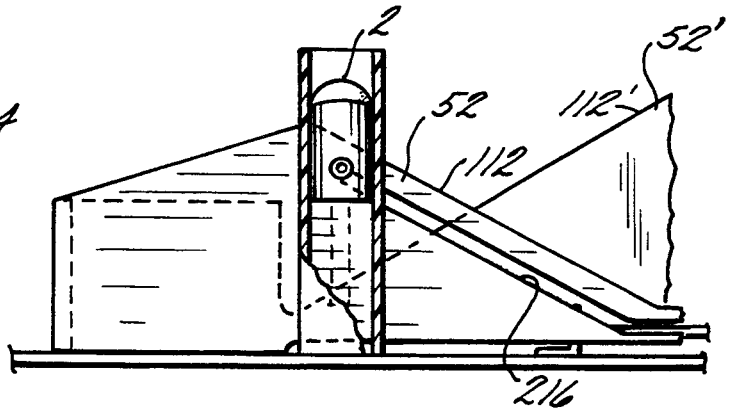
FIG. 14 is a front view of the view of FIG. 13.

A first alternate embodiment is depicted in FIGS. 13 and 14 which includes a second piston 210 for mounting the golf ball 2 onto the tee 162. The piston 210 has a slot 212, an inner surface 213 of which is angled to mate with the camming surface 112 and disposed cross axially with the former is a mounting fastener 214. A guide slot 216, which is generally parallel to camming surface 112, is provided within the camming plate 52 wherein mounting fastener 214 travels when the camming plate is reciprocated. The mounting fastener 214 is provided to prevent the piston 210 from being stopped from moving downwardly within the chamber 147.

Figure 15:
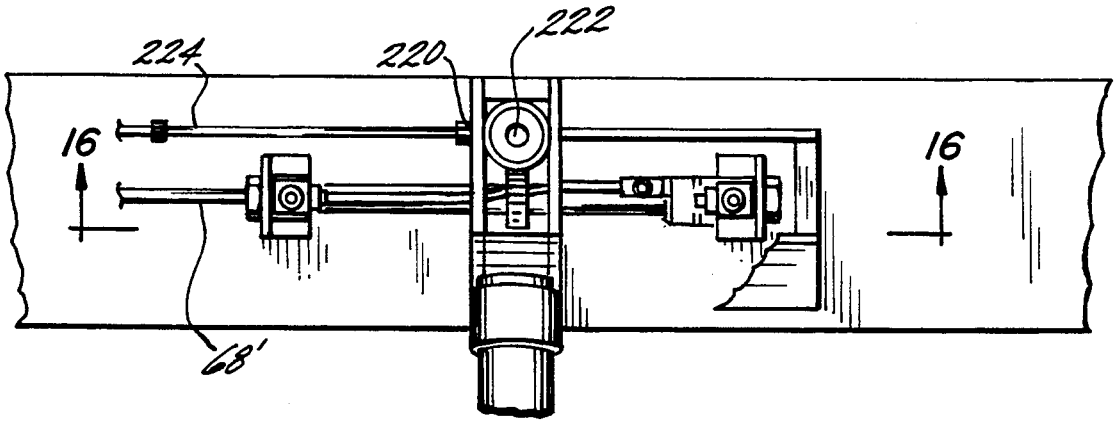
FIG. 15 is a top plan view of an alternate embodiment of the actuation means.
Figure 16:
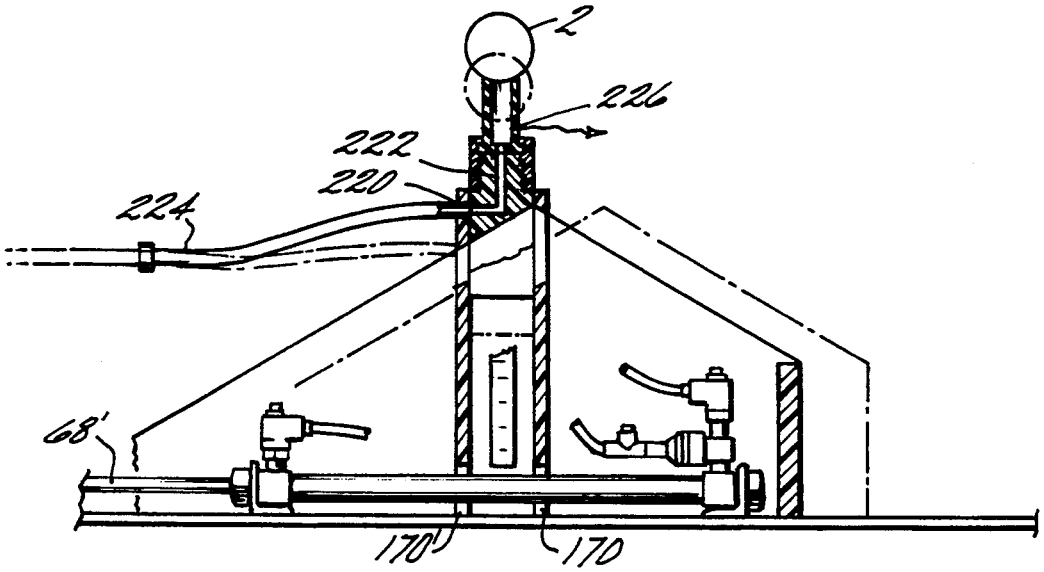
FIG. 16 is a sectional view along line 16—16 of FIG. 15.

A second alternate embodiment is illustrated in FIGS. 15 and 16 and includes a means for sensing when the golf ball 2 has been struck from the tee and, upon sensing such, automatically tees up another golf ball. To achieve this, the piston 56 includes a bore 220 which communicates with a central aperture 222 of the tee 162. It will be appreciated that a non-contacting air limit switch assembly 228 provides a continuous regulated sensing jet of air 245 through a flexible conduit 224, bore 220 and aperture 222, escaping through an open mouth 226 of the hollow rubber tee 162. The assembly 228 is comprised of a pressure regulator 246, a non-contacting air limit switch 247 and a fluidic interface valve 248 (FIG. 18D). The air limit switch 247 may, for example, be the proximity switch part number 1022 manufactured and sold by Clippard Laboratory. The fluidic interface valve 248 may, for example, be the fluidamp valve part number 2010 manufactured and sold by Clippard Laboratory. The pressure regulator 246 may, for example, be the miniature regulator part number R364-01C manufactured and sold by Watts Fluidair. When the sensing jet 245 is uninterrupted by contact with a solid object, no supply air 80 passes through its fluidic interface valve 248. Conversely, when the sensing jet 245 is interrupted by the presence of a solid object, such as a golf ball 2 coming to rest on the open mouth 226 of tee 162, the supply air 80 passes through valve 248 of the pneumatic circuit.

Figure 18A:
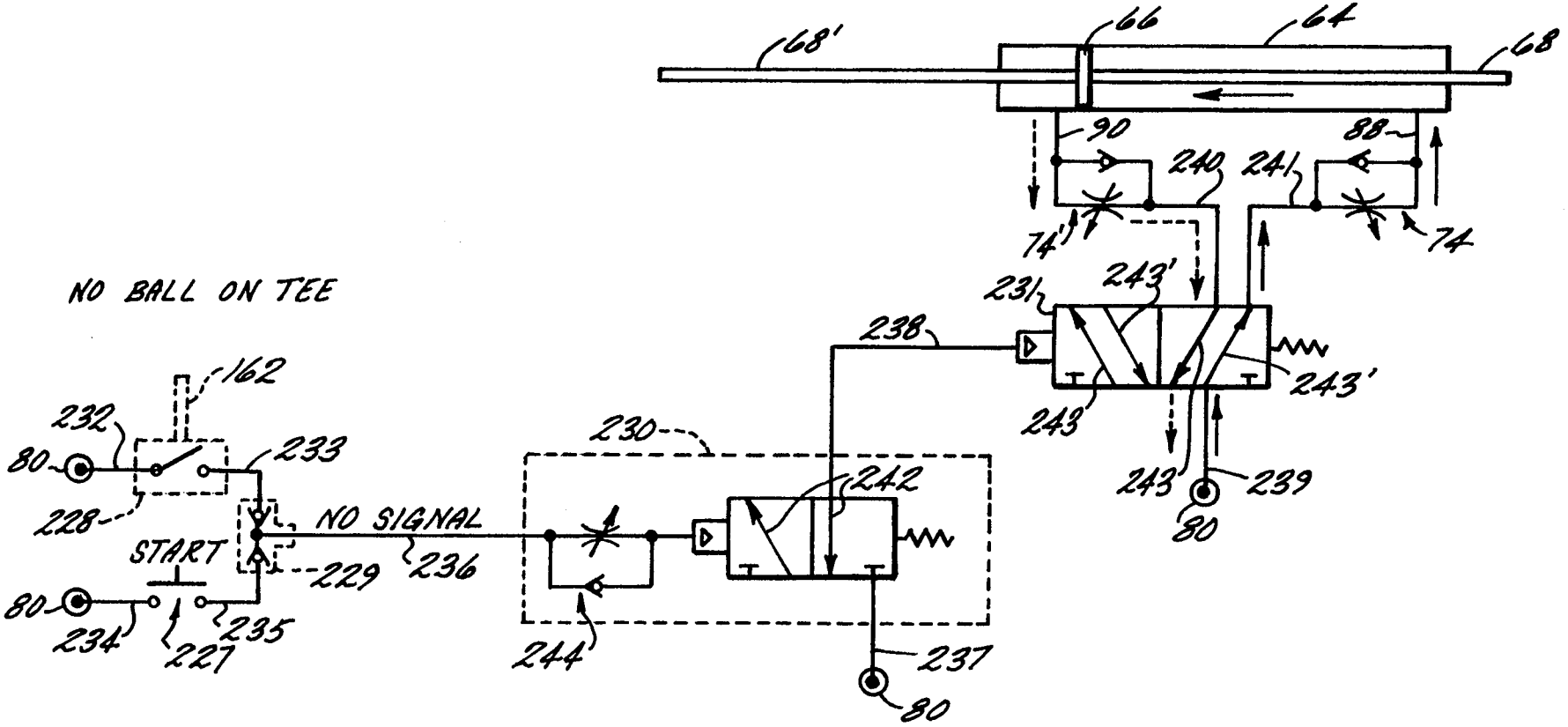
FIGS. 18A–D are schematic diagrams showing actuation means in accordance with an alternate embodiment of the present invention.
Figure 18B:
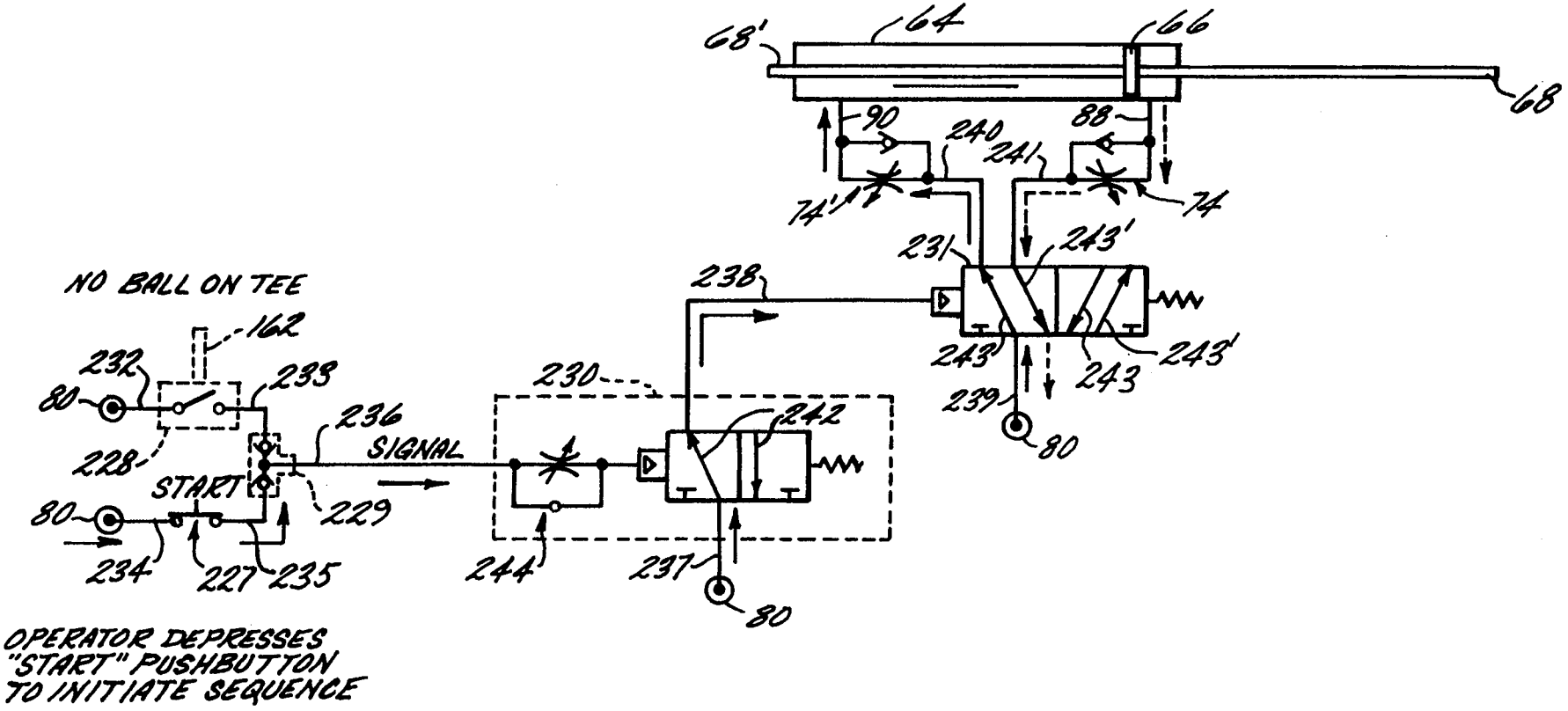
Figure 18C:
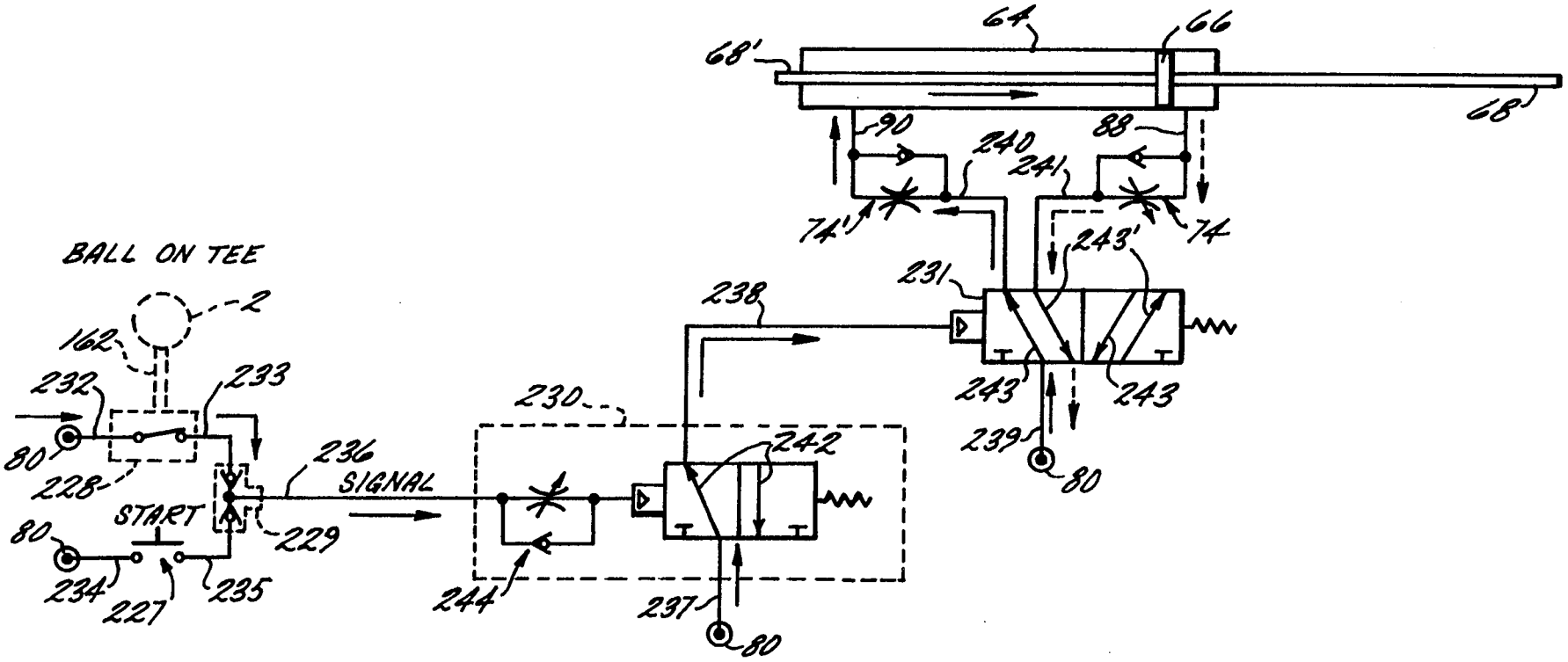
Figure 18D:
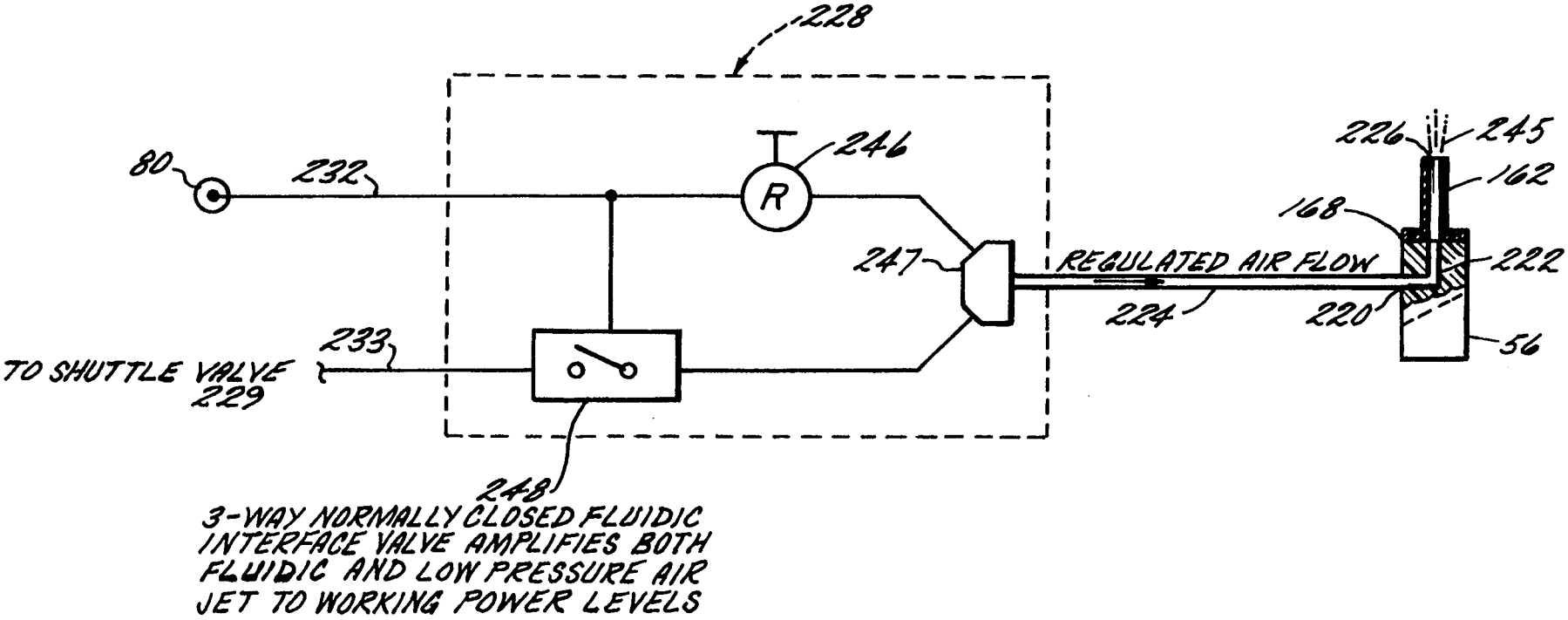

When no new ball presents itself at the lower edge 142 of input tube 136, such as at the end of the golf ball supply or the beginning of a new supply, the system is at rest, as is best shown in FIG. 18A. It becomes necessary to start the sequence manually as is clearly shown in FIG. 18B. This is accomplished by a manual push button 227 (shown in phantom in FIG. 1) which is mounted on horizontal beam 36 and plumbed in parallel with the air limit switch assembly 228 in an "OR" configuration through a shuttle valve 229 which prevents back-feed, as push button 227 or switch 228 is actuated. The operator depresses the manual push button 227 and holds it. The manual push button 227 may, for example, be the palm button control valve part number 460-2 manufactured and sold by Aro Fluid Products. Instantaneously, supply air 80 is directed through the manual push button 227 to the pilot of a time delay valve 230 through conduit 235, shuttle valve 229 and conduit 236, overriding the spring return of valve 230. The time delay valve 230 may, for example, be the three way delay off valve part number R-341 manufactured and sold by Clippard Laboratory. The shuttle valve 229 may, for example, be part number MSV-1 also manufactured and sold by Clippard Laboratory. Supply air 80 is directed through conduit 237 through port 242 to the pilot of four-way pilot operated spring return valve 231 through conduit 238, overriding the spring return of valve 231. The four-way pilot operated spring return valve 231 may, for example, be the four-way, two position, pilot actuated, spring return valve part number 5040-07 manufactured and sold by Aro Fluid Products. Supply air 80 is now directed through conduit 239 through port 243 into the actuation cylinder 64 through conduit 240, extending piston 66 which simultaneously raises the tee assembly (i.e., piston 56, tee 162 and receptacle 168) and allows a golf ball 2 to drop into position over slide surface 112. At this time, the operator releases the manual push button 227. The spring return of valve 230 returns the valve to its de-energized position after a selected time delay, as the exhausting air decays through an internal variable speed controller 244. De-energization of time delay valve 230 causes valve 231 to de-energize, shifting the supply air 80 to port 243' through conduit 239 causing piston 66 to retract. As it retracts, a new ball 2 is rolling up the inclined surface 112 and the tee assembly is is being lowered to receive it. When the new ball 2 drops over the peak 200 onto the tee 162, the sensing jet 245 is interrupted, as is shown in FIG. 18C, supply air 80 is once again directed to the pilot of time delay valve 230 through conduit 233, shuttle valve 229 and conduit 236 and the sequence continues as previously defined. The purpose of the time delay "off" valve 230 is to prevent the pneumatic circuit from chattering, which may occur when the ball 2 wobbles as it settles on the tee 162 after dropping from peak 200 or during its transition to rest. It also provides an interval free of switching noise immediately following the golfer's swing and follow-through. The above described alternate embodiment replaces the threshold sensor 78 and valve 76 of the first embodiment.

While the above systems have been described as a pneumatic systems (e.g., gas or liquid) any other means of actuation may be employed, for example, a known type electrical linear actuator drive mechanism.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A device for teeing a golf ball comprising:

tee means for supporting a golf ball;

housing guide means having first guide means wherein said tee means is slidably disposed and having second guide means for receiving a golf ball;

lateral sliding reciprocating means guided by third guide means of said housing guide means, said sliding reciprocating means for reciprocating said tee means and a golf ball in a cooperating manner to transfer the golf ball onto said tee means, said third guide means of said housing guide means comprises first and second slot means, said sliding reciprocating means includes a first camming plate having a first camming surface, said first camming plate adapted for passing through said slot means, said sliding reciprocating means also includes a second camming plate having a second camming surface adapted for passing through said second slot means, said tee means includes a first piston having a tee, said first piston having means for engaging said second camming surface; and actuator means for actuating said sliding reciprocating means, said actuator means reciprocates said first camming plate and said second camming plate in a generally recilinear manner.

2. The device of claim 1 wherein:

said first camming surface is inclined at a first angle; and said second camming surface is also inclined at said first angle.

3. The device of claim 2 wherein:

said first camming plate has a first transverse axis;

said second camming plate has a second transverse axis; and said first transverse axis is disposed at an acute second angle with respect to said second transverse axis.

4. The device of claim 3 wherein said input means includes:

an input tube disposed at an acute third angle with respect to a transverse axis of said housing guide means, said input tube extending through an aperture in said housing guide means, said input tube also including a portion disposed within said housing guide means.

5. The device of claim 4 wherein said third angle is about 8°.

6. The device of claim 3 wherein:

said first camming plate and said second camming plate are generally the same shape.

7. The device of claim 3 wherein:

said first camming plate is inversely mounted with respect to said second camming plate.

8. The device of claim 7 including:

end plate means for spacing said first and said second camming plates, said end plate means including an angular surface for providing said second angle.

9. The device of claim 3 wherein said second angle is about 16°.

10. The device of claim 2 wherein said first angle is about 30.5°.

11. The device of claim 1 wherein said actuator means includes:

a cylinder having a second piston which is urged in a first direction and a second direction by a compressed gas, said piston being interconnected with said first and said second camming plates.

12. The device of claim 11 wherein:

said cylinder includes a first connector disposed at a first end of said cylinder and a second connector disposed at a second end of said cylinder;

said actuator means further includes a two position valve having a button disposed thereat for urging said two position valve in one direction, said two position valve adapted for providing in a first position a positive pressure to said first connector and a negative pressure to said second connector and in a second position a negative pressure to said first connector and a positive pressure to said second connector;

a pair of speed controllers interconnected with said two position valve and adapted for controlling the velocity of the second piston; and a threshold sensor adapted for sensing a back pressure at said first end of said cylinder, said threshold sensor also adapted for urging said two position valve in another direction.

13. The device of claim 12 wherein said cylinder includes:

a first arm interconnected with a first side of said second piston and also being interconnected with a first end of each of said first and second camming plates; and a second arm interconnected with a second side of said second piston and also being interconnected with a second end of each of said first and second camming plates.

14. The device of claim 1 including:

means for adjusting the height of said tee.

15. The device of claim 14 wherein said means for adjusting the height of the tee includes:

a rod having a threaded portion disposed at one end and a handle portion disposed at a second end, said rod adapted for varying a linear dimension of said rectilinear motion of said camming plates; and a stabilizing mount adapted for receiving said threaded portion of said rod.

16. The device of claim 15 wherein said stabilizing mount includes:

a base portion;

an upright portion mounted to said base portion and said upright portion having a threaded bore; and two side portions connecting said base portion and said upright portion.

17. The device of claim 1 wherein said means for engaging said second camming surface includes:

a slot in said first piston having an engaging surface which is shaped for engaging said second camming surface of said second camming plate.

18. The device of claim 1 wherein:

said first slot means includes a first pair of slots, each of said first pair of slots disposed at opposing sides of said housing guide means; and said second slot means includes a second pair of slots, each of said second pair of slots disposed at opposing sides of said housing guide means.

19. The device of claim 1 including:

a base whereon said housing guide means is disposed.

20. The device of claim 1 including:

a second piston disposed within said second guide means of said housing guide means, said second piston including means for engaging said first camming surface.

21. The device of claim 20 wherein said means for engaging said first camming surface includes:

a slot in said second piston having an engaging surface which is shaped for engaging said first camming surface of said first camming plate.

22. The device of claim 1 wherein said actuator means includes:

sensing means for sensing when the golf ball has been moved from said tee; and switch means for receiving input from said sensing means and effecting reciprocation by said actuator means.

23. The device of claim 1 wherein said tee is replaceably mounted to said piston.

24. The device of claim 1 including:

a platform having feed means for feeding the golf balls, said feed means communicating with said second guide means, said platform includes a mounting portion for mounting said housing guide means thereon, said platform including a first aperture wherethrough said tee extends, said platform also including a second aperture wherethrough a tee height adjustment means extends.

25. A device for teeing a golf ball comprising:

tee means for supporting a golf ball;

housing guide means having first guide means wherein said tee means is slidably disposed and having second guide means for receiving a golf ball;

lateral sliding reciprocating means guided by third guide means of said housing guide means, said sliding reciprocating means for reciprocating said tee means and a golf ball in a cooperating manner to transfer the golf ball onto said tee means;

actuator means for actuating said sliding reciprocating means; and a guide disposed within an opening of said housing guide means, said guide having first and second guide surfaces, said guide together with said housing guide means defining said first and second guide means.

26. The device of claim 25 wherein:

said first and second guide means each comprises a chamber defined between said guide and said housing guide means.

27. The device of claim 26 wherein:

said guide is generally triangular in shape.

* * * * *